US007275629B2

(12) United States Patent
Fukumoto et al.

(10) Patent No.: US 7,275,629 B2
(45) Date of Patent: Oct. 2, 2007

(54) DRIVING APPARATUS FOR A MOVABLE MEMBER OF AN AUTOMOBILE

(75) Inventors: Ryoichi Fukumoto, Nagoya (JP); Tomoaki Nishimura, Kariya (JP); Hiroki Okada, Okazaki (JP)

(73) Assignee: Aisin Seiki Kabushiki Kaisha, Kariya-shi Aichi-ken (JP)

( * ) Notice: Subject to any disclaimer, the term of this patent is extended or adjusted under 35 U.S.C. 154(b) by 157 days.

(21) Appl. No.: 11/061,530

(22) Filed: Feb. 22, 2005

(65) Prior Publication Data

US 2005/0183924 A1 Aug. 25, 2005

(30) Foreign Application Priority Data

Feb. 23, 2004 (JP) ..... 2004-046471

(51) Int. Cl.
*E05F 15/14* (2006.01)

(52) U.S. Cl. ..... 192/84.961; 296/146.4

(58) Field of Classification Search ..... 296/146.4; 192/84.961

See application file for complete search history.

(56) References Cited

U.S. PATENT DOCUMENTS

| | | | | |
|---|---|---|---|---|
| 4,566,574 | A * | 1/1986 | Marshall | 192/84.961 |
| 4,984,668 | A * | 1/1991 | Onishi et al. | 192/84.961 |
| 5,138,795 | A | 8/1992 | Compeau et al. | |
| 6,237,737 | B1 * | 5/2001 | Jorgensen et al. | 192/84.961 |
| 6,964,449 | B2 * | 11/2005 | Takeda et al. | 296/146.4 |

FOREIGN PATENT DOCUMENTS

| | | |
|---|---|---|
| JP | 2002-327576 | 11/2002 |
| WO | WO 02/102615 A2 * | 12/2002 |

* cited by examiner

*Primary Examiner*—Rodney H. Bonck
(74) *Attorney, Agent, or Firm*—Finnegan, Henderson, Farabow, Garrett, & Dunner L.L.P.

(57) ABSTRACT

A driving apparatus for a movable member of an automobile comprises a housing, a drum for driving the movable member, the drum being rotatably supported on the housing, and a clutch for selectively transmitting a driving torque to the drum, wherein the clutch is accommodated in a space of the drum.

5 Claims, 5 Drawing Sheets

DRIVING APPARATUS FOR A MOVABLE MEMBER OF AN AUTOMOBILE

CROSS REFERENCE TO RELATED APPLICATIONS

This application is based on and claims priority under 35 U.S.C. §119 with respect to Japanese Patent Application No. 2004-046471 filed on Feb. 23, 2004, the entire content of which is incorporated herein by reference.

FIELD OF THE INVENTION

The present invention relates to a driving apparatus for a movable member of an automobile.

BACKGROUND

According to JP2002-327576A, an apparatus automatically drives (opens and closes) a slide door for a side opening of an automobile. The apparatus comprises a housing, an output drum rotatably supported on the housing through a rotatable shaft, a motor for generating a driving torque and a clutch for selectively transmitting the driving torque from the motor to the output drum. A reduction mechanism is interposed between the output drum and the motor. A cable is installed between the output drum and an input drum connected to the slide door so that the driving torque is transmitted from the output drum to the slide door. The output drum, the reduction mechanism and the clutch are coaxially installed on the shaft. The apparatus is complicated in construction so that minitualization thereof is restricted.

SUMMARY OF THE INVENTION

In light of the foregoing, the present invention provides a driving apparatus for a movable member of an automobile comprising a housing, a drum for driving the movable member, the drum being rotatably supported on the housing, and a clutch for selectively transmitting a driving torque to the drum, wherein the clutch is accommodated in a space of the drum.

BRIEF DESCRIPTION OF THE DRAWINGS

The foregoing and additional features and characteristics of the present invention will become more apparent from the following detailed description when considered with reference to the accompanying drawings, wherein.

DETAILED DESCRIPTION

Figure 1:
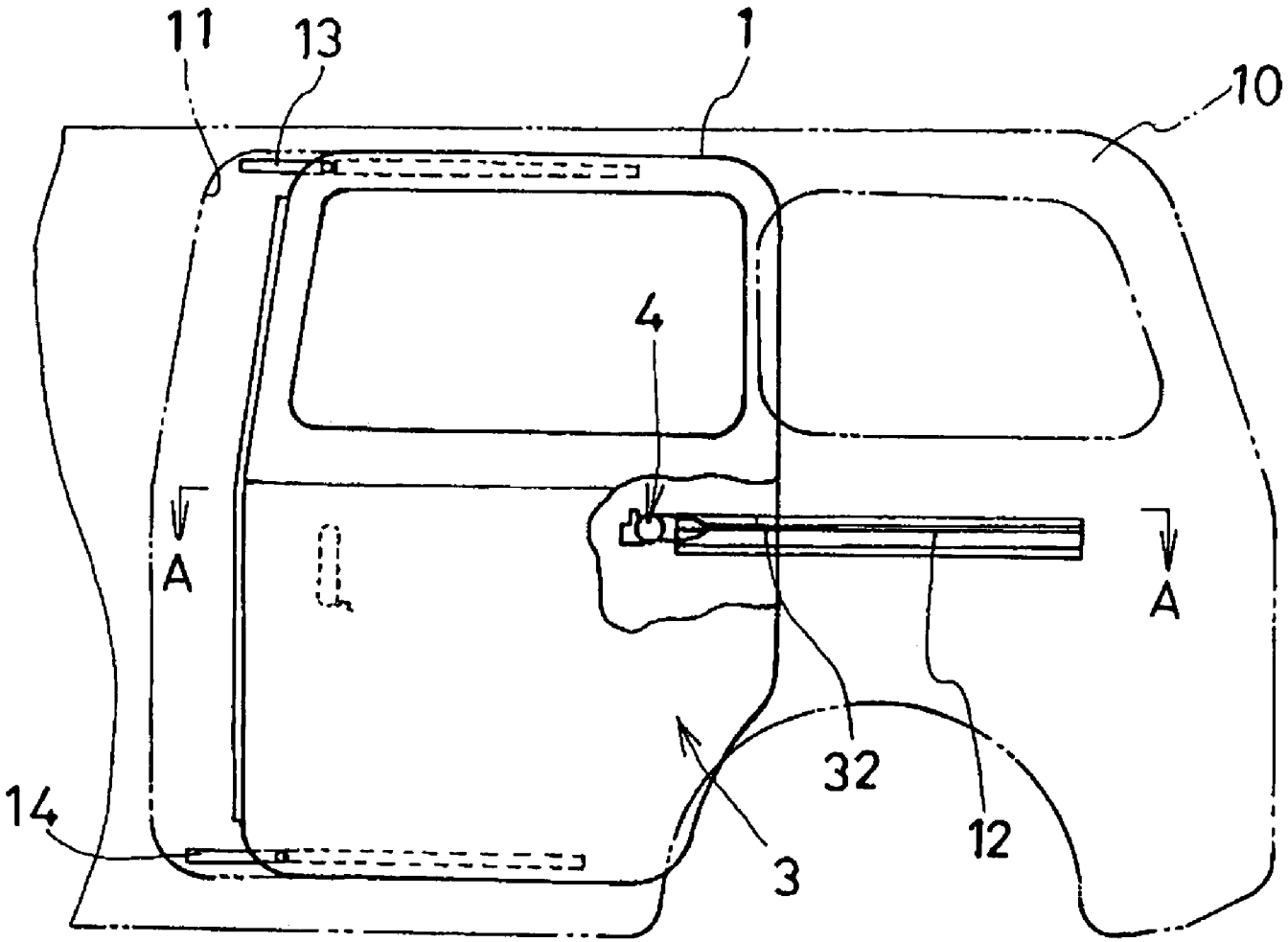
FIG. 1 is a constructive view of a driving apparatus for a movable member of an automobile according to the invention.

Embodiments of the present invention will be explained with reference to illustrations of the drawing figures as follows.

Figure 2:
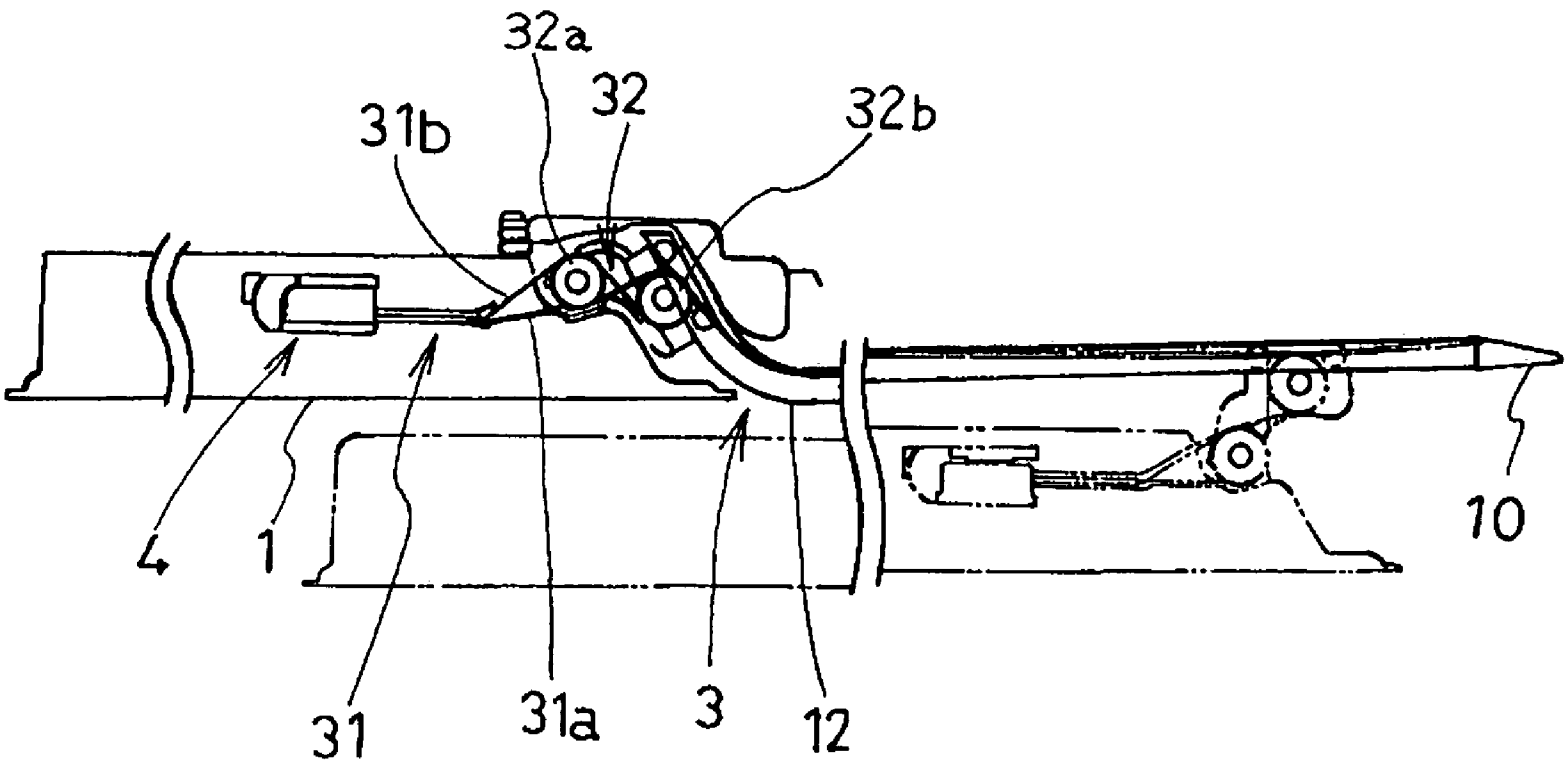
FIG. 2 is an upper view of the driving apparatus of FIG. 1.

As shown in FIGS. 1 and 2, an automobile 100 is equipped with a slide door (a movable member) 1 for opening and closing a side opening 11 of the automobile so that a passenger rides in and gets out the automobile. The side opening 11 is formed on a side body 10 of the automobile. A center guide rail 12 and a pair of upper as well as lower guide rails 13 and 14 are fixed to the side body 10 in front and rearward direction of the automobile. The slide door 1 is slidably supported on the side body 10 through the rails 12, 13 and 14.

Figure 3:
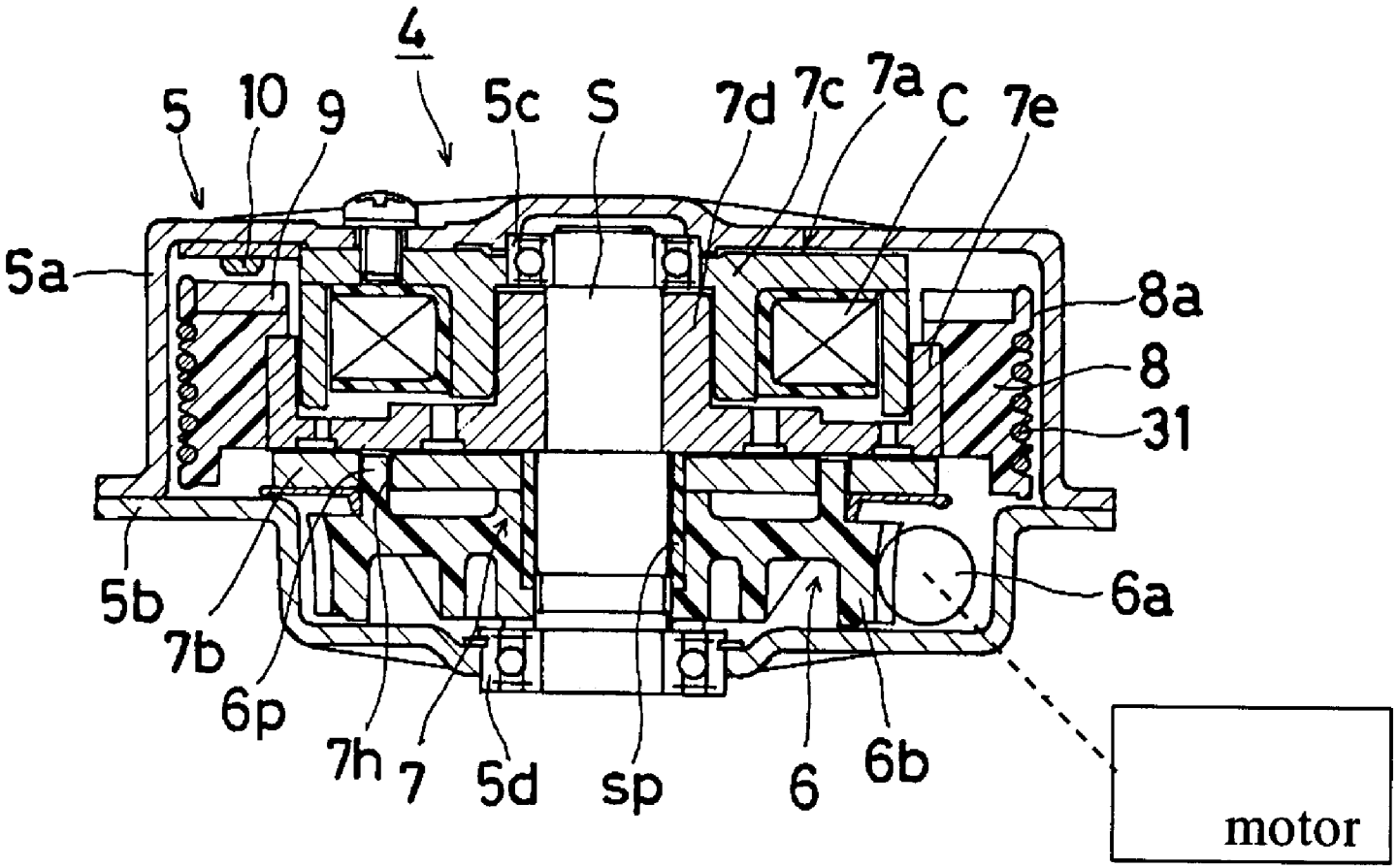
FIG. 3 is a cross-sectional view of a driving apparatus according to a first embodiment of the invention.

Referring to FIG. 3, a first embodiment is explained hereinafter. A driving apparatus 4 is installed in the slide door 1 and a cable 31 comprises wires 31*a* and 31*b* that is wound on and/or out the driving apparatus 4. A pair of pulleys 32 (32*a* and 32*b*) is installed so that the slide door 1 slides along the center guide rail 12. Each of the wires 31*a* and 31*b* is fixed to an output drum 8 (FIG. 3) of the driving apparatus 4 at one end and wound on the drum while each of the wires 31*a* and 31*b* is fixed near of front end of the center guide rail to the side body 10 at the other end. The wires 31*a* and 31*b* are guided by the pulleys 31*a* and 32*b* so as to be passed through the center guide rail 12.

The driving apparatus 4 comprises a housing 5, a reduction mechanism 6, a clutch 7 and an output drum 8. The housing 5 comprises a cover 5*a* and a base 5*b* and the cover 5*a* is fixed to the base by a connecting member (not shown). The reduction mechanism 6, the clutch 7 and the output drum 8 are accommodated in a space of the housing 5. Bearings 5*c* and 5*d* are fixed to the cover 5*a* and the base 5*b*, respectively, so that a rotational shaft S is supported on the housing S therethrough.

The well-known reduction mechanism 6 comprises a worm gear 6*a* fixed to an output shaft of a motor (not shown) and a disk-shaped worm wheel gear (input member) 6*b* that is geared with the worm gear 6*a*. The worm wheel gear 6*b* is rotatably supported on the shaft S through a cylindrical spacer sp. The spacer sp is fixed to the gear 6*b* so that the gear 6*b* and the spacer sp uniformly rotate.

The clutch 7 comprises a solenoid mechanism 7*a* and an armature 7*b*. The solenoid mechanism 7*a* comprises a cylindrical-shaped core 7*c* for holding a coil C wound on a bobbin as well as a disk-shaped rotor 7*d* facing to the armature 7*b* and the core 7*c* in axial direction. The core 7*c* made of a magnetic material is fixed to the cover Sa of the housing 5. The rotor 7*d* made of a magnetic material is fixed to the shaft S so as to integrally rotate. The output drum 8 is fixed to an outer circumference 7*e* of the rotor 7*d*.

The disk-shaped armature 7*b* made of magnetic material is located between the worm wheel gear 6*b* and the rotor 7*d* so that upper and lower planes of the armature 7*b* face an upper side of the worm wheel gear 6*b* and a lower plane of the rotor 7*d*, respectively. The armature 7*b* is rotatably and movably, in axial direction, supported on the spacer sp so that the armature 7*b* is rotatably and movably, in axial direction, supported on the shaft S through the spacer sp. A plurality of holes 7*h* are provided in the armature 7*b* so that a plurality of projections 6*p* of the worm wheel gear 6*b* is inserted into the holes 7*h*, respectively. The worm wheel gear 6*b* and the armature 7*b* are connected each other through the projections 6*p* and the holes 7*h*. The armature 7*b* integrally rotates with the worm wheel gear 6*b* so that a driving torque of the motor is transmitted to the armature 7*b* through the reduction mechanism 6.

While the coil C is energized, a magnetic flux is generated through the coil C, the armature 7*b*, the core 7*c* and the rotor 7*d* so that armature 7*b* is adsorbed on the rotor 7*d*. Namely, the armature 7*b* moves to the rotor 7*d* on the spacer sp in axial direction and the armature 7*b* is frictionally engaged with the rotor 7*d*. Here, the driving torque of the motor is transmitted to the rotor 7*d* through the reduction mechanism 6 and the armature 7*b*. While the coil C is not energized, no magnetic flux is generated through the coil C, the armature 7*b*, the core 7*c* and the rotor 7*d* so that armature 7*b* is apart from the rotor 7*d*. Namely, no frictional engagement between the armature 7*b* and the rotor 7*d* is established. Here, the driving torque of the motor is not transmitted to the rotor 7*d*.

The output drum 8 made of resin is cylindrically shaped. The output drum 8 is fixed on an outer portion 7*e* of the rotor 7*d* so that the rotor 7*d* and the output drum 8 are integrally rotate. The armature 7*b*, the core 7*c* and the rotor 7*d* are located near by the output drum 8. Namely, most portion of the clutch 7 is accommodated in the inner space of the cylindrical-shaped output drum 8. Namely a dead-volume space of the output drum 8 is occupied by the clutch 7 so that space is sufficiently used in axial direction of the shaft S. A ring-shaped magnet 9 is fixed on the upper face of the output drum 8 so that N- and S-poles of the magnet 9 are alternatively arranged. Revolution number and direction are detected by the magnet 9 in cooperation with a hole IC 9.

The coil C of the solenoid mechanism 7*a* is energized so that the armature 7*b* and the rotor 7*d* are frictionally engaged each other. The driving torque of the motor is transmitted to the rotor 7*d* since the torque passes through the reduction mechanism 6 and the armature 7*b*. That is, the armature 7*b* and the rotor 7*d* integrally rotate each other so that the output drum 8 also rotates with the rotor 7*d* integrally. One of the wires 31*a* and 31*b* is wound on the output drum 8 and the other of them is wound out the output drum 8 so that the slide door 1 moves in open/close direction.

The coil C of the solenoid mechanism 7*a* is not energized so that the armature 7*b* and the rotor 7*d* are not engaged each other. The slide door 1 is, therefore, manually operated and the output drum 8 rotates in accordance with the movement of the slide door 1 through the wires 31*a* and 31*b*. The rotation of the output drum 8 is not transmitted to the armature 7*b* and the clutch 6. Namely, smooth and/or easy manually operation of the slide door is achieved.

Figure 4:
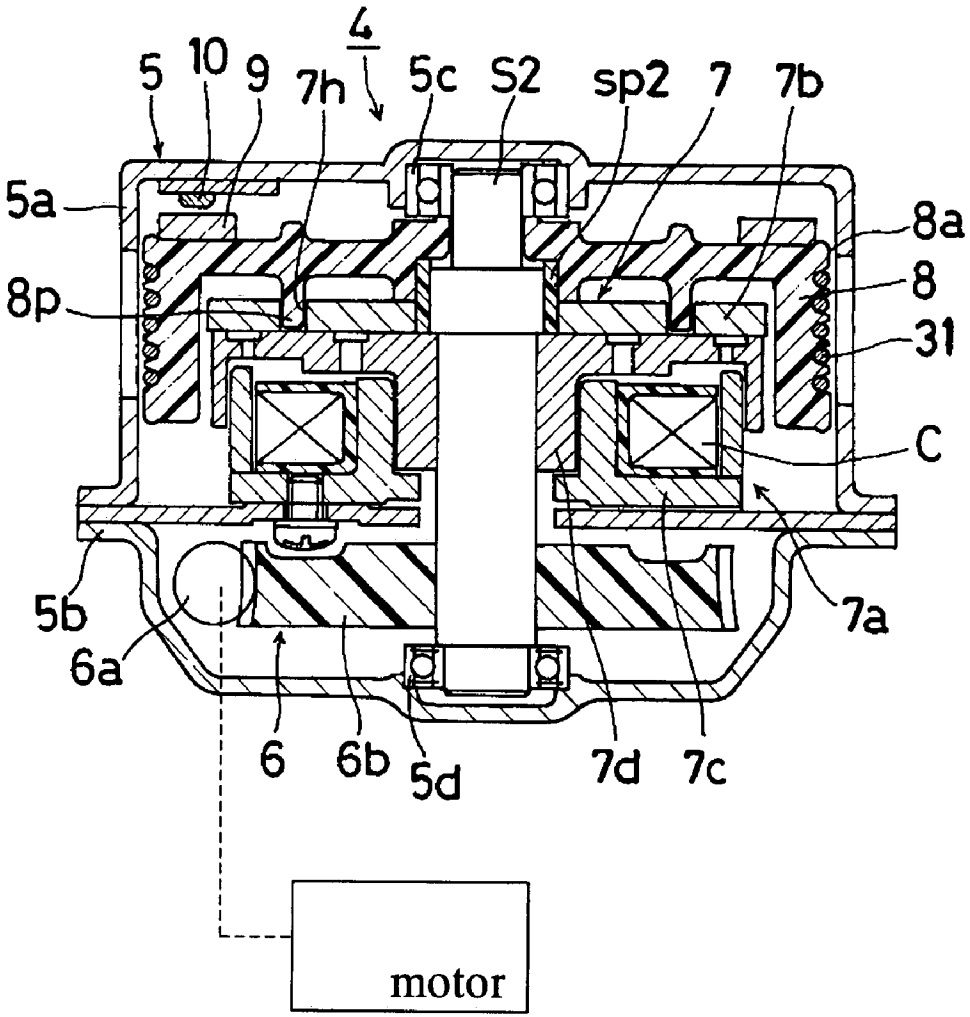
FIG. 4 is a cross-sectional view of a driving apparatus according to a first embodiment of the invention.

Referring to FIG. 4, a second embodiment is explained hereinafter. Common numbers are employed for common elements of the second embodiment in comparison with the first embodiment. A worm wheel gear 6*b* and a rotor 7*d* are fixed to a shaft S2 so that the gear 6*b* and the rotor 7*d* integrally rotate. A driving torque of a motor is transmitted to the rotor 7*d* through a reduction mechanism 6. An armature 7*b* is rotatably and movably, in axial direction, supported on the shaft S2 through the spacer sp2. The armature 7*b* is located between the rotor 7*d* and an output drum 8. A plurality of holes 7*h* is provided in the armature 7*b* so that a plurality of projections 8*p* of the output drum 8 is inserted into the holes 7*h*, respectively. The armature 7*b* and the output drum 8 are connected each other through the holes 7*h* and the projections 8*p*. The output drum 8 is formed cup-shaped in axial direction so that a clutch comprising the armature 7*b*, a core 7*c* and the rotor 7*d* is accommodated in the inner space of the output drum 8.

Figure 5:
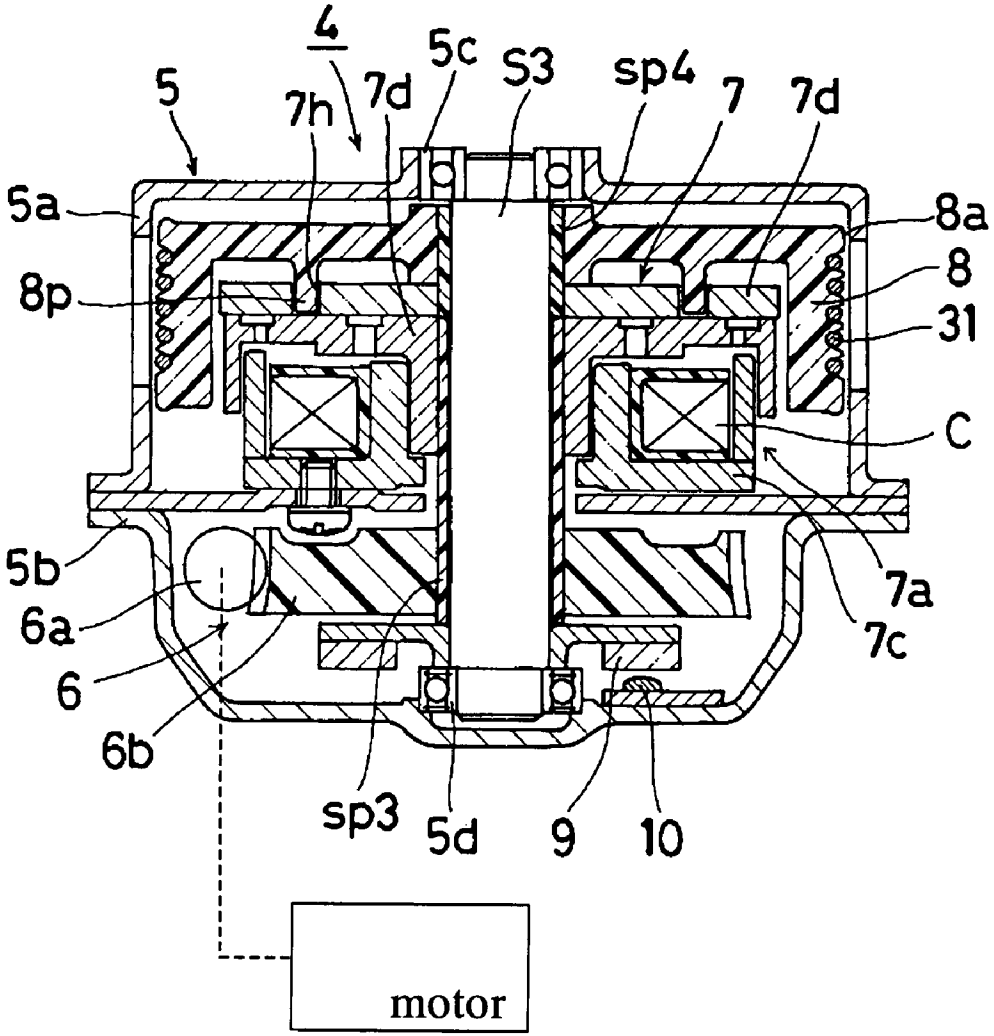
FIG. 5 is a cross-sectional view of a driving apparatus according to a first embodiment of the invention.

Referring to FIG. 5, a third embodiment is explained hereinafter. Common numbers are employed for common elements of the third embodiment in comparison with the first embodiment. A worm wheel gear 6*b* and a rotor 7*d* are fixed to a spacer sp3 so that the gear 6*b* and the rotor 7*d* are rotatably supported on a shaft S3 through the spacer sp3. The gear 6*b* and the rotor 7*d* integrally rotate each other. A driving torque of a motor is transmitted to the rotor 7*d* through a reduction mechanism 6. An armature 7*b* is rotatably and movably, in axial direction, supported on the shaft S3 through the spacer sp4. The armature 7*b* is located between the rotor 7*d* and an output drum 8. A plurality of holes 7*h* is provided in the armature 7*b* so that a plurality of projections 8*p* of the output drum 8 is inserted into the holes 7*h*, respectively. The armature 7*b* and the output drum 8 are connected each other through the holes 7*h* and the projections 8*p*. The output drum 8 is formed cup-shaped in axial direction so that a clutch comprising the armature 7*b*, a core 7*c* and the rotor 7*d* is accommodated in the inner space of the output drum 8.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A driving apparatus for a movable member of an automobile comprising:

a housing;

a rotor fixed to a shaft and rotatably supported on the housing by the shaft;

a drum for driving the movable member and fixed to an outer circumference of the rotor;

a transmitting member wound outside of the drum, wherein the movable member is driven by the transmitting member;

an armature for selectively transmitting a driving torque to the rotor and rotatably supported on the shaft; and a clutch comprised of the rotor and the armature, wherein the clutch is accommodated in a space of the drum.

2. The driving apparatus according to the claim 1, wherein the clutch further comprises:

a core fixed to the housing; and a coil wound around the core.

3. The driving apparatus according to the claim 2, wherein the armature is rotatably supported on the shaft through a spacer.

4. The driving apparatus according to the claim 2, further comprising an input member for providing the armature with the driving torque, wherein a plurality of holes are provided in the armature so that a plurality of projections of the input member is inserted into the holes, respectively.

5. The driving apparatus according to the claim 2, wherein the drum is formed in cylindrical shape so as to be fixed to the rotor and house the rotor, the armature and the core.

* * * * *